US005799521A

United States Patent [19]

Kennedy

[11] Patent Number: 5,799,521

[45] Date of Patent: Sep. 1, 1998

[54] SECURITY BAR WITH INDICATOR

[75] Inventor: Samuel Kennedy, 540 Timothy Street, Apt. 302, Newmarket, Ontario, Canada, L3Y 5N9

[73] Assignees: Gerardus J. Brouwer, Keswick; Samuel Kennedy, Newmarket, both of Canada

[21] Appl. No.: 802,024

[22] Filed: Feb. 18, 1997

[51] Int. Cl.[6] ..... E05B 13/00

[52] U.S. Cl. ..... 70/416; 70/422; 70/94; 70/432; 292/DIG. 65; 292/339; 292/259 R

[58] Field of Search ..... 70/57, 58, 14, 70/163–169, 229–232, 94, 416, 417, 422, 432, 439–441, 465, DIG. 56, DIG. 58, DIG. 59; 292/259 R, 288, 289, 338, 339, DIG. 65, DIG. 66

[56] References Cited

U.S. PATENT DOCUMENTS

| | | | |
|---|---|---|---|
| 197,187 | 11/1877 | Voege | 292/339 X |
| 415,437 | 11/1889 | Bensel et al. | 70/422 |
| 779,032 | 1/1905 | Draudt | 70/422 |
| 1,076,851 | 10/1913 | Welshans | 70/422 |
| 1,176,407 | 3/1916 | Shirey . | |
| 2,812,095 | 11/1957 | Sutherland | 292/339 X |
| 3,280,606 | 10/1966 | Howard et al. | 70/91 |
| 3,729,963 | 5/1973 | Hintz | 70/230 |
| 3,797,005 | 3/1974 | Schwarz | 70/94 X |
| 3,895,507 | 7/1975 | Moy | 70/DIG. 58 X |
| 4,300,796 | 11/1981 | Lane | 292/339 |
| 4,491,354 | 1/1985 | Williams | 292/148 |
| 4,593,946 | 6/1986 | Rich | 292/339 X |
| 4,792,168 | 12/1988 | Kardosh | 292/288 |
| 4,852,921 | 8/1989 | Gilbert et al. | 292/288 |
| 4,971,374 | 11/1990 | Lovell et al. | 292/339 |
| 5,340,172 | 8/1994 | Sweet | 292/259 |
| 5,466,023 | 11/1995 | Williamson | 292/289 X |
| 5,474,343 | 12/1995 | Ledbetter | 292/289 X |

FOREIGN PATENT DOCUMENTS

| | | | |
|---|---|---|---|
| 25550 | of 1902 | United Kingdom | 292/DIG. 65 |

*Primary Examiner*—Suzanne Dino Barrett
*Attorney, Agent, or Firm*—Bereskin & Parr

[57] ABSTRACT

A security indicator has a two part telescopic locking bar attached to the handle of a door at one end and to the door or door jamb at the other end through an end piece. The device includes a cup or tube which encases the door handle, preventing use of the handle. The length of the bar is fixed by aligning apertures in each part of the telescopic locking bar to form a continuous aperture, inserting a frangible pin through the continuous aperture and locking the frangible pin in place with a padlock received by a hole in the frangible pin. The pin has a narrow portion which can be broken by relatively little human force. The device requires someone who does not have the key to the padlock on the frangible pin to break the frangible pin to enter a door fixed with the device. A broken pin alerts the occupant that an entry has occurred during his/her absence. A sleeve normally protects the narrow portion but slides easily away to expose the narrow portion when entry is desired.

17 Claims, 4 Drawing Sheets

FIG. 2.
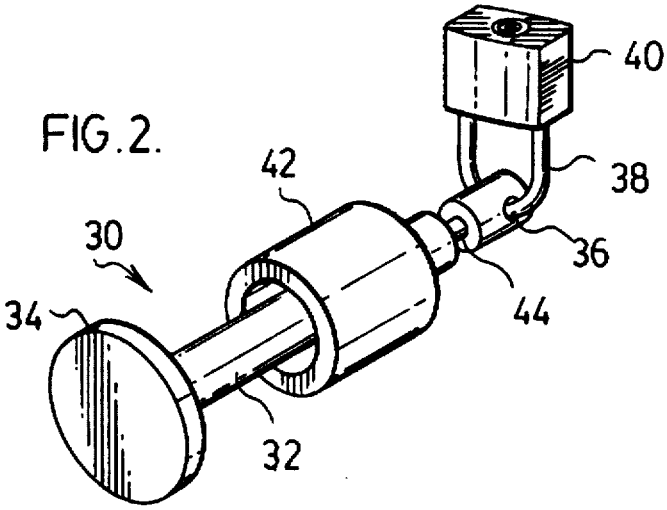
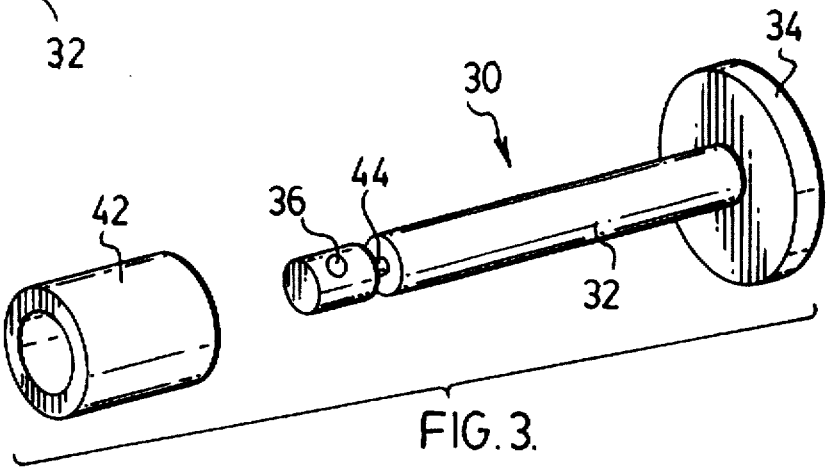
FIG. 3.
FIG. 4.
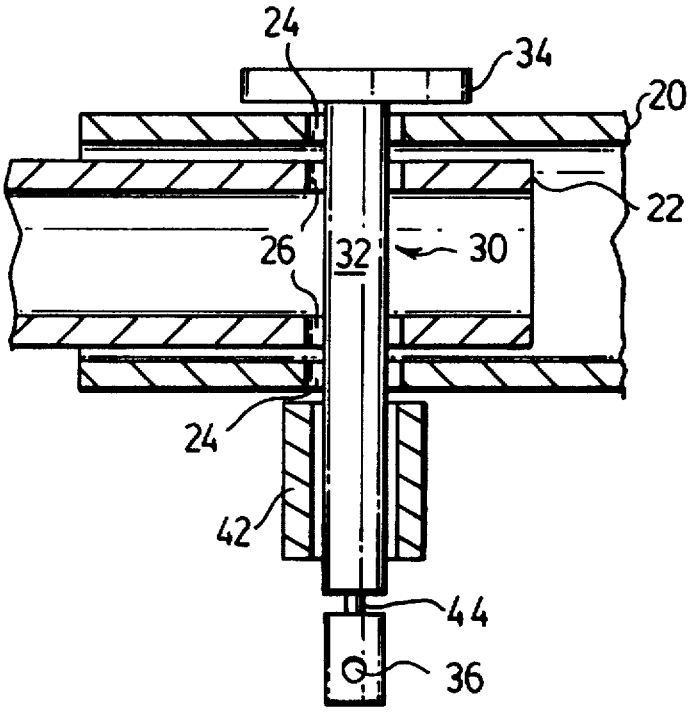

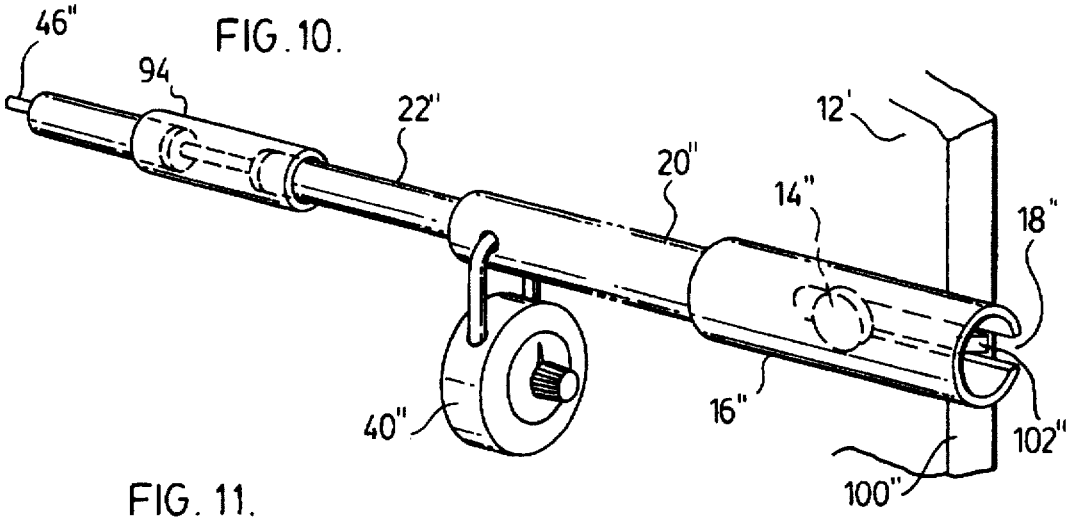
FIG. 10.
FIG. 11.
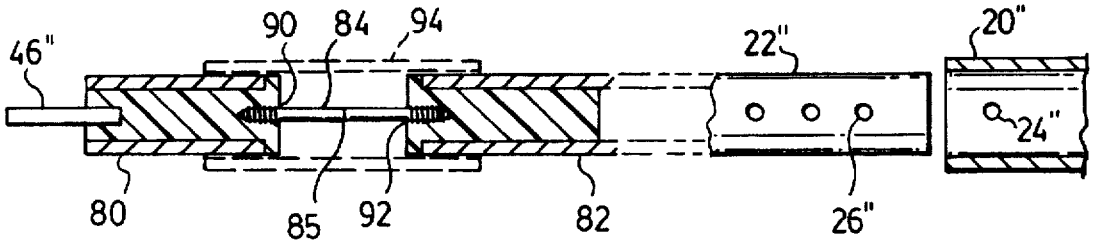
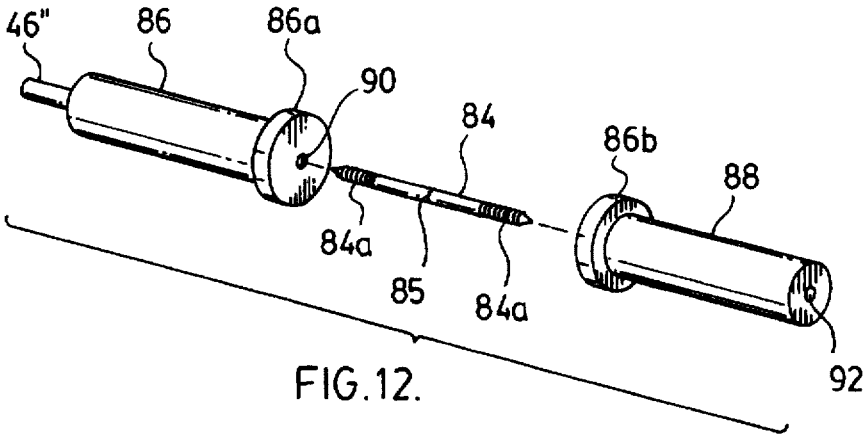
FIG. 12.

SECURITY BAR WITH INDICATOR

FIELD OF THE INVENTION

This invention relates to a security bar which normally prevents opening of a door allowing access to a room, but which can be broken to allow access and which then indicates that the door has been opened.

BACKGROUND OF THE INVENTION

There are many cases when more than one person has the means of safely disengaging a security device. For example, duplicate keys may exist for a lock and more than one person may be told the combination or code to a burglar alarm. There may be many different reasons why multiple access is necessary. However, allowing more than one person to have access to a security device often makes it difficult to determine whether and when someone who is able to safely disengage the security device has deactivated the device for an unauthorized or improper purpose.

A common example of this situation is found in the landlord and tenant relationship. In an emergency situation, such as in case of a water main break or other mechanical malfunction, a superintendent or landlord must be able to have immediate access to the apartment, and to all rooms in the apartment, to enter and make repairs. Consequently, most tenants are required to provide the landlord and/or superintendent with the means of quickly disengaging whatever security devices are installed. However, this means that the landlord or superintendent can enter any room in the apartment at any time. Therefore, it is difficult for a tenant to know whether the landlord or superintendent has entered a room in their apartment while they were absent.

It would therefore be desirable to have some mechanism which indicates when an unsupervised entry into a room has occurred. Such a device should not prevent or unduly interfere with someone entering for a legitimate purpose such as in an emergency.

BRIEF SUMMARY OF THE INVENTION

Accordingly, the invention in one of its aspects provides:

A security holder for a door to a room, said door having a door jamb and a handle, said security holder comprising:

(a) a bar having first and second bar portions, (b) said first portion including engaging means movable to a position in which said engaging means covers at least a portion of said door handle to prevent operation of said door handle, (c) means for connecting said second bar portion to said door or door jamb, (d) a locking device comprising a lock for locking said bar portions to each other in fixed relationship in which said first bar portion prevents operation of said door handle, (e) said security holder having a readily frangible portion which can be broken to allow removal of said bar portions from said door with said lock still in place, so that said door can be opened, so that said security holder normally prevents entry into said room and so that said frangible portion provides a visible indication when entry has occurred.

Further objects and advantages of the invention will appear from the following description, taken together with the accompanying drawings.

BRIEF DESCRIPTION OF THE DRAWINGS:

In the drawings:

FIG. 2 is a perspective view of a frangible pin for the locking bar of FIG. 1 with a padlock at one end and a floating sleeve located along the frangible pin;

FIG. 3 is a perspective view of the sleeve and frangible pin of FIG. 2 with the sleeve removed from the frangible pin;

FIG. 4 is a sectional view of the frangible pin of FIG. 2 without the padlock in position on the telescopic locking bar;

FIG. 10 is a perspective view of a further embodiment of the invention;

FIG. 11 is a sectional view of a portion of the apparatus of FIG. 10; and FIG. 12 is a perspective exploded view of a portion of the apparatus of FIG. 11.

Figure 1:
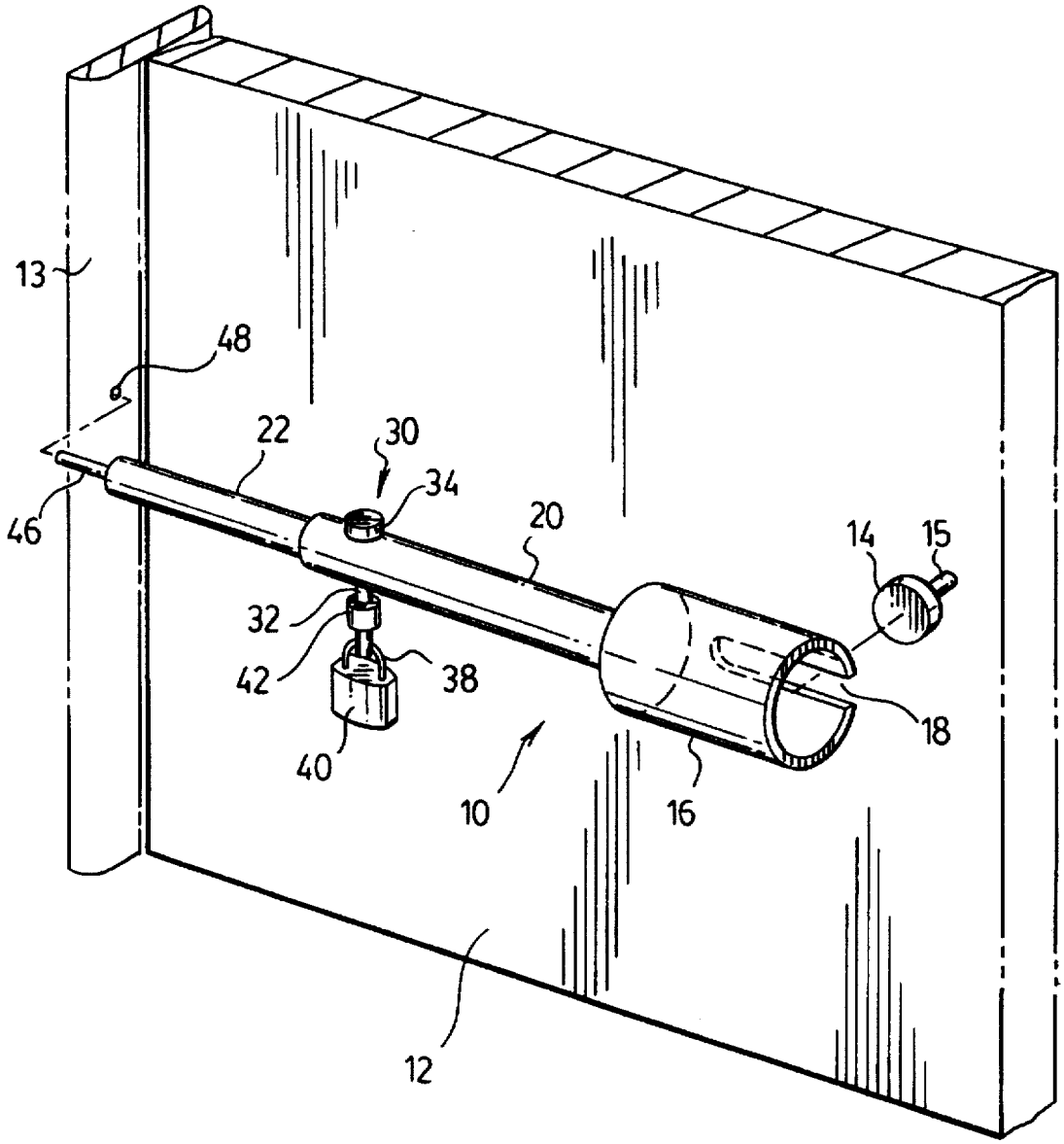
FIG. 1 is a perspective view of showing a telescopic locking bar according to the invention applied to a door.

DETAILED DESCRIPTION OF THE PREFERRED EMBODIMENTS:

Reference is made next to the drawings which show a telescopic locking bar generally indicated at 10, located on a door 12 and made in accordance with the present invention. The door 12 is hinged to a jamb 13 and has a conventional handle, in this case a doorknob 14 having a stem 15.

A cup 16 having a slot 18 is located at one end of the bar 10. The cup 16 encloses and encases the doorknob 14 preventing the doorknob 14 from being turned to open the door 12. The slot 18 receives the stem 15 of the doorknob 14. It will be recognized that the configuration of the cup 16 depends upon the shape of the handle of the door 12 and that other types of handles may require a differently shaped cup 16 designed to encase the particular shape of the handle.

The locking bar 10 includes two parts: an outer bar 20 and an inner bar 22 sliding in telescopic relation to one another. An aperture 24 (FIG. 4) extends through the outer bar 20 and one or more apertures 26 extend through the inner bar 22 of the bar 10. The relative position of the outer and inner bars 20 and 22 can be telescopically adjusted to align the apertures 24 and 26 to form a continuous aperture which extends through both parts. The cup 16 is attached to one end of the outer bar 20.

A frangible pin 30, illustrated in FIGS. 2 to 4, includes a shaft 32 having a stop or flange 34 at one end, and a hole 36 through shaft 32 at the other end. The hole 36 is for receiving the shackle 38 of a conventional padlock 40. A sleeve 42 floats on the shaft 32. The shaft 32 has a narrowed or weakened portion 44 near the hole 36. The narrow portion 44 enables a person to break the frangible pin 30 at the narrow portion 44 with relatively little unassisted force. To this end, the frangible pin 30 is comprised of a brittle, breakable plastic material. In addition, the shaft 32 is long enough so that the sleeve 42 can be slid back toward the outer bar 20 to uncover the weakened part 44, to permit the weakened part to be broken. Normally however the sleeve 42 covers, protects and hides the weakened part 44.

The inner bar 22 includes an axial end pin 46 extending therefrom, at its end remote from the end containing the aperture or apertures 26.

The locking bar 10 is attached to the door 12 in the following manner. A hole 48 is drilled in the door jamb 13, at the same height as the door handle 14. The inner and outer bars 20, 22 are telescoped inwardly toward each other to shorten the locking bar 10, and the end pin 46 is inserted into the hole 48 in the jamb 13. The outer bar 20 is then slid outwardly on the inner bar 22 until the cup 16 extends over the door handle 14 with the door handle stem 15 received in the slot 18 of the cup. The extension of the two bars is continued until the apertures 24, 26 in the inner and outer bars are aligned. To allow some tolerance in this procedure, more than one aperture 26 may be provided as indicated, and the cup 16 may be long enough so that it covers the door handle 14 to a greater or lesser extent. The cup 16 is in all cases made shallow enough so that there is no room for an unauthorized person's hand to reach inside the cup to turn the door handle 14.

After the apertures 24, 26 are aligned, the frangible pin 30 is inserted through the apertures. The sleeve 42 is then placed on the shaft 32 of the pin 30, and the padlock 40 is locked through the hole 36 in the shaft.

The precise dimensions of the locking bar described will depend on the size of the door 12 and the shape of the door handle 14. Most apartment doors are of only a few standard sizes, and the device is made to fit the most common sizes of apartment door.

As shown, the stop or flange 34 is larger in diameter than the apertures 24, 26 in the outer and inner bars 20, 22 of the locking bar 10. The stop 34 and the padlock 40 together prevent the pin 30 from being removed from the apertures 24, 26. The sleeve 42 is placed over the shaft of the pin 30 below the bar 10 but above the hole 36 to allow the padlock 40 to be attached through the hole 36. Once the padlock is attached, the bar 10 is locked into place and cannot be removed from the door 12. With the locking bar 10 attached, the door handle 14 cannot be turned to open the door.

Normally, the force of gravity will draw the sleeve 42 downwards to rest along the shackle of the padlock 40. In this position the sleeve 42 will protect the narrow portion 40 against accidental impacts.

To open the door without having a key to the padlock 40, a person simply lifts the sleeve 42 to expose the narrowed or weakened portion 44, and then breaks off the frangible pin 30 at the narrow portion 44 to remove the end containing the padlock 40. The remainder of the pin 30 can then be drawn from the apertures 24, 26. With the pin gone, the outer bar 22 can be slid telescopically on the inner bar 20, towards the door jamb 13, shortening the length of bar 10 and allowing bar 10 and its cup 16 to be removed from the door handle 14. The door can then be opened. However even if the user restores the locking bar to its former position, the broken pin 30 will provide a clear indication that an entry has been made through the door 12.

The locking bar 10 can be non-destructively disengaged by unlocking the padlock 40 and removing the frangible pin 30 from the apertures 24, 26.

Therefore, after the locking bar 10 is fixed in place, no one can enter into the room unless the person with the key to the padlock releases the padlock, or unless someone breaks the frangible pin 30. It will be recognized that only certain authorized persons, such as the occupant, will have access to the key to the padlock 40 on the frangible pin 30. Thus, if someone else makes an unauthorized entry, they will have to break the pin 30 providing a clear indication that such an unauthorized entry has occurred. Therefore, a tenant using the locking bar 10 may comply with his or her obligation to the landlord to provide means for emergency entry, by giving the landlord a key for all locks on the door 12. However, the tenant need not provide the landlord with the key to the padlock 40 since if an emergency entry is necessary, the landlord can disengage the locking bar 10 by breaking the frangible pin 30. In this way, the locking bar 10 will deter the landlord from entering the tenant's premises unless there is a justifiable reason to do so.

It will be recognized that the inner and outer bars can be reversed, ie: the inner bar can be the part which attaches to the cup 16 and the outer bar can include end pin 46. However preferably the two parts are in a telescopic relation to each other.

Figure 7:
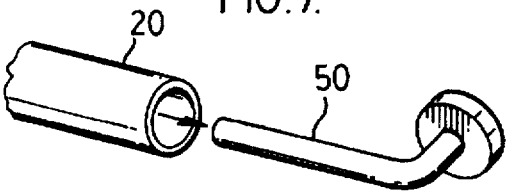
FIG. 7 is a perspective view of an embodiment of the invention for use with a lever handle.
Figure 7A:
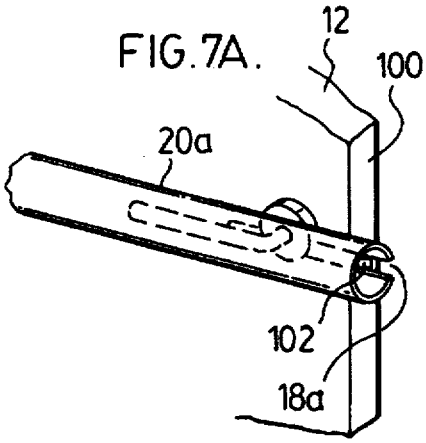
FIG. 7A is a view similar to FIG. 7 but showing a modified embodiment.

If the door has a lever handle, as shown in FIG. 7, then the cup 16 is not necessary. Instead, the free end of the outer bar 20 is simply made large enough to be pushed over the lever handle 50, as indicated in dotted lines in FIG. 7. Alternatively, if desired and as shown in FIG. 7A, the bar 20*a* may have a slot 18*a* (similar to the arrangement shown in FIG. 1) and may project sufficiently past the edge 100 of the door 12 to cover the door latch 102. This will deter the use of a screwdriver to pry back the door latch in order to open the door 12 without disturbing the security bar arrangement.

Figure 5:
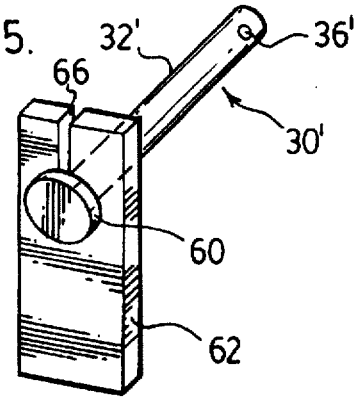
FIG. 5 is a perspective view of a portion of another embodiment of the invention.
Figure 6:
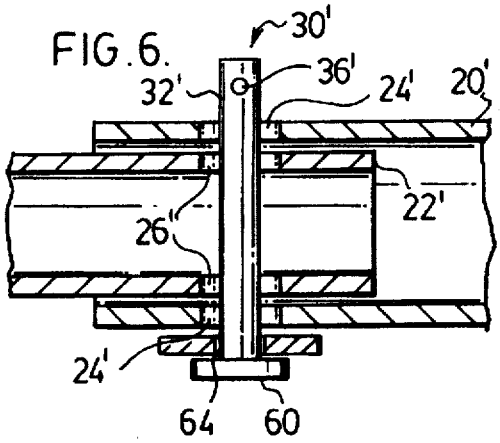
FIG. 6 is a sectional view of the embodiment of FIG. 5.

It will be realized that different parts of the pin arrangement for holding the inner and outer bars 20, 22 may be frangible. For example, as shown in FIGS. 5 and 6, where primed reference numerals indicate parts corresponding to those of the previous drawings, the pin 30' may simply be a metal pin having a small flange 60 at one end and a hole 36' at the other end. The hole 36' receives the padlock 40, while the flange 60 is sufficiently small so that it may be drawn through the holes 24, 26. However withdrawal of the flange 60 through the holes 24, 26 is normally prevented by a frangible plastic tab 62 having an opening 64 to receive the shaft 32' of pin 30', and a slot 66 extending from opening 64 to the periphery of the tab 62, to weaken the tab. In use, if a superintendent or other person does not have the key to the padlock 40, he or she simply breaks the tab 62, thus allowing the pin 30' to be withdrawn (with the padlock still attached) through the apertures 24, 26. As before, removal of the pin 30' allows the inner and outer bars 20', 22' to be telescoped together and removed from the door handle, allowing the door to be opened.

Figure 8:
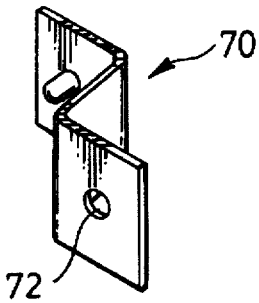
FIG. 8 is a perspective view of an end piece which fits between the edge of the door and the jamb as shown in FIG. 1.
Figure 8A:
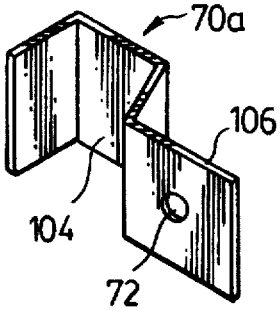
FIG. 8A is a perspective view of a modified end piece.
Figure 9:
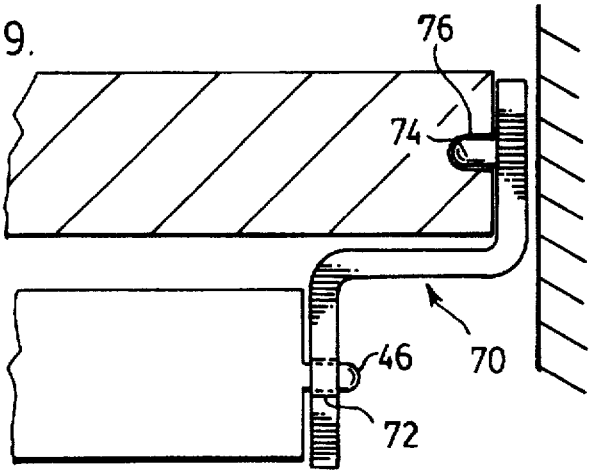
FIG. 9 is a sectional view of the end piece of FIG. 8 attached to the door.

If it is preferred not to drill a hole in the door jamb 13, then for some doors a double L-shaped end piece 70 (FIGS. 8, 9) may be provided, formed of thin metal. The end piece 70 may be inserted between the edge of the door and the door jamb 13 and contains a small opening 72 to receive the pin 46. The end piece may if desired include a projection 74 to be housed in a mating recess 76 in the door edge, to help locate the end piece 70. Alternatively, the end piece 70*a* as shown in FIG. 8A may be used. End piece 70*a* includes a U-shaped portion 104 to receive the edge of the door, and a flange 106 projecting from one leg of the U-shaped portion 104 and containing the opening 72 to receive the pin 46. This avoids the need to drill a hole either in the door jamb 13 or in the door 12.

Reference is next made to FIGS. 10 to 12, which show another embodiment of the invention and in which double primed reference numerals indicate parts corresponding to those of FIGS. 1 to 9.

In the FIGS. 10 to 12 embodiment, the outer and inner bars 20", 22" are locked directly together by padlock 40" which extends through a hole 24" in outer bar 20" and through one of a series of holes 26" in inner bar 22". The frangible portion, which will now be described, is built directly into inner bar 22".

Specifically, inner bar 22" includes two bar sections 80, 82, spaced axially apart and held together by a thin axial rod 84 (which may for example be a wooden dowel). Rod 84 has a very small circumferential groove 85 in its outer surface, forming a weakened location so that the rod 84 will break at groove 85 when stressed. In a preferred construction, a flanged plastic plug 86 is inserted into bar section 80 (which as before is typically of thin tubular aluminum construction), and another flanged plastic plug 88 (identical to plug 86) is inserted into bar section 82. The height of the flanges **86*a*, 86*b* above the remainder of the plugs 86, 88 is equal to the thickness of the aluminum wall of the bar sections 80, 82 so that the flanges 86*a*, 86*b* form a stop for the tubular bar sections 80, 82**.

Each plug 86, 88 has an axial hole 90, 92 drilled therein, of diameter and length adequate to receive the thin axial member or dowel 84. Plug 86 also receives the metal end pin 46". Holes 90, 92 are of equal length and admit only the desired part of rod 84, to center the groove 85 in the space between the plugs.

In a typical embodiment, the diameter of thin axial member 84 was about 4 mm, while the diameter of the tubular members 80, 82 was about 25 mm. The length of the portion of member 84 extending between the plugs 86, 88 was about 30 mm, plus about 40 mm penetration into each plug. The thin axial member 84 can readily be broken, allowing disengagement of the bar section 86 from the remainder of inner bar 22" and from outer bar 20". This is sufficient to allow the bars to be removed from the door, so that the door can be opened. The security bar can readily be repaired by replacing the broken thin axial member 84 with another similar member (e.g. another piece of wooden dowel). The broken pieces are first removed from the openings 90, 92 (an operation which is facilitated since rod 84 breaks at its center, at groove 85), and a new thin axial rod 84 is then reinserted in these openings.

Preferably the thin axial member 84 contains threads **84*a* at each end thereof, and preferably the holes 90, 92 contain matching threads, so that if an intruder breaks the axial member 84**, he will not easily be able to replace it with a conventional unthreaded wood dowel.

Preferably a tubular sleeve 94 is provided to cover the weakened portion 84 so that the weakened portion will not normally be visible. The tubular sleeve 94 can be slid axially along the inner bar 22" to expose the weakened portion 84 for breakage when required. An advantage of the sleeve 94 is that when it is in place over the weakened portion 84, it helps protect the weakened portion against accidental breakage.

While preferred embodiments of the invention have been described, it will be appreciated that various changes may be made within the spirit of the invention, and such changes are intended to be within the scope of the appended claims.

I claim:

1. A security holder for a door to a room, said door having an inside surface located in said room and an outside surface opposite said inside surface, a door jamb, and a handle on said outside surface, said security holder comprising:

(a) a bar having first and second bar portions, (b) said first bar portion including engaging means movable to a position in which said engaging means covers at least a portion of said door handle to prevent operation of said door handle, (c) means for connecting said second bar portion to said door or door jamb so that said bar extends over said outside surface of said door, (d) a locking device comprising a combination lock or a key lock for locking said bar portions to each other in fixed relationship in which said first bar portion prevents operation of said door handle, (e) said security holder having a readily frangible portion which can be broken to allow removal of said bar portions from said door with said lock still in place, so that said door can be opened, so that said security holder normally prevents entry into said room and so that said frangible portion provides a visible indication from the outside surface of said door when entry has occurred.

2. The device of claim 1 wherein said locking device includes a first part containing said readily frangible portion and a second part for receiving said lock.

3. The device of claim 1 wherein said bar portions each include at least one aperture extending therethrough, and wherein said apertures on said first and second bar portions may be aligned to form a continuous aperture through both said bar portions, said locking device including a pin extendable through said continuous aperture.

4. The device according to claim 3 wherein said bar portions are each tubular bars.

5. The device of claim 4 wherein said pin includes said frangible portion.

6. The device of claim 5 wherein said pin includes a shaft having a pair of ends, a flange at one end, said flange being of size larger than said continuous aperture for preventing withdrawal of said flange through said aperture, said frangible portion comprising a narrowed part of said shaft adjacent the other end of said pin, said shaft including an opening therethrough and positioned between said narrowed portion and said other end to allow the shackle of a padlock to be passed through said opening.

7. The device of claim 4 wherein said locking device includes a pin adapted to extend through said continuous aperture and having a flange at one end thereof, said flange being smaller than said continuous aperture so that said -flange may be drawn through said continuous aperture, said pin having an opening at the other end thereof adapted to receive the shackle of a padlock, and a frangible tab having an opening therein adapted to receive said pin, said frangible tab being placed between said flange and said bar so that said tab may be broken thereby allowing removal of said pin through said apertures with said lock still attached.

8. The device of claim 1 wherein one of said bar portions has an axial end pin extending therefrom, said pin being adapted to be received in a holder.

9. The device of claim 8 including a metal member adapted to be received between an edge of said door and said door jamb and having an opening therein to receive said pin.

10. The device of claim 1 wherein said engaging means includes a cup having a slot therein, so that said engaging means covers substantially all of said door handle.

11. The device of claim 1 wherein said readily frangible portion comprises a weakened portion in one of said bar portions.

12. The device of claim 11 wherein said one bar portion comprises first and second axially aligned bar sections, said bar sections having first cross sections, and a thin axial member of substantially lesser cross section than said first cross section extending between said first and second bar sections, said thin axial member being said readily frangible portion.

13. The device of claim 12 and including a sleeve slidable on said one bar portion to cover and uncover said thin axial member.

14. The device of claim 13 wherein said first and second bar sections are of hollow tubular form, said device including a first plug inserted in said first bar section and a second plug inserted in said second bar section, said plugs having axial openings therein, said thin axial member being slidably and removably received in said axial openings, so that if said thin axial member is broken, the pieces thereof can be removed and said thin axial member can be readily replaced.

15. The device of claim 14 wherein said thin axial member is a wooden dowel.

16. The device of claim 15 wherein said dowel has a circumferential groove therein between said plugs.

17. The device of claim 1 wherein said engaging means includes means adapted to cover a latch of said door.

* * * * *